US009856762B2

(12) United States Patent
Engelhardt

(10) Patent No.: US 9,856,762 B2
(45) Date of Patent: Jan. 2, 2018

(54) VARIABLE-STROKE VALVE TRAIN OF AN INTERNAL COMBUSTION ENGINE

(71) Applicant: Schaeffler Technologies AG & Co. KG, Herzogenaurach (DE)

(72) Inventor: Helmut Engelhardt, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 64 days.

(21) Appl. No.: 15/034,685

(22) PCT Filed: Nov. 4, 2014

(86) PCT No.: PCT/DE2014/200617
§ 371 (c)(1),
(2) Date: May 5, 2016

(87) PCT Pub. No.: WO2015/067269
PCT Pub. Date: May 14, 2015

(65) Prior Publication Data

US 2016/0290183 A1 Oct. 6, 2016

(30) Foreign Application Priority Data

Nov. 11, 2013 (DE) ..... 10 2013 222 820

(51) Int. Cl.
*F01L 1/34* (2006.01)
*F01L 13/00* (2006.01)
*F01L 1/053* (2006.01)
*F01L 1/26* (2006.01)

(52) U.S. Cl.
CPC ..... *F01L 13/0005* (2013.01); *F01L 1/053* (2013.01); *F01L 1/267* (2013.01); *F01L 13/0036* (2013.01); *F01L 2001/0537* (2013.01); *F01L 2013/001* (2013.01)

(58) Field of Classification Search
CPC ... F01L 13/0005; F01L 13/0036; F01L 1/053; F01L 1/267; F01L 2001/0537; F01L 2013/001
USPC ..... 123/90.17
See application file for complete search history.

(56) References Cited

U.S. PATENT DOCUMENTS 7,762,225 B2 * 7/2010 Dengler ..... F01L 1/047 123/90.44
2010/0199945 A1 4/2010 Meintschel et al.
2010/0236237 A1 9/2010 Spiegel et al.
2010/0288217 A1 11/2010 Stolk et al.
(Continued)

FOREIGN PATENT DOCUMENTS

DE 102005006489 8/2006
DE 102007042932 3/2009
(Continued)

OTHER PUBLICATIONS

Middendorf, Hermann et al., Ottomotor mit Zylinderabschaltung, In: MTZ—Motortechnische Zeitschrift,vol. 73, H.3, 2012, pp. 186-193.

*Primary Examiner* — Zelalem Eshete
(74) *Attorney, Agent, or Firm* — Volpe and Koenig, P.C.

(57) ABSTRACT

The invention relates to a DOHC sliding cam valve train of an internal combustion engine with a four-cylinder in-line arrangement and cylinder shutoff. One of the two camshafts has two shared cam pieces for the respective adjacent engine cylinders.

6 Claims, 3 Drawing Sheets

(56) References Cited

U.S. PATENT DOCUMENTS

| | | | |
|---|---|---|---|
| 2012/0138000 | A1 | 6/2012 | Schadel et al. |
| 2015/0047588 | A1 | 2/2015 | Eppinger et al. |

FOREIGN PATENT DOCUMENTS

| | | |
|---|---|---|
| DE | 102008005639 | 7/2009 |
| DE | 102008049103 | 4/2010 |
| DE | 102009009470 | 10/2010 |
| DE | 102009016902 | 10/2010 |
| DE | 102009034990 | 2/2011 |
| DE | 102011002136 | 10/2012 |
| DE | 102012002026 | 8/2013 |
| DE | 102012004420 | 9/2013 |

* cited by examiner

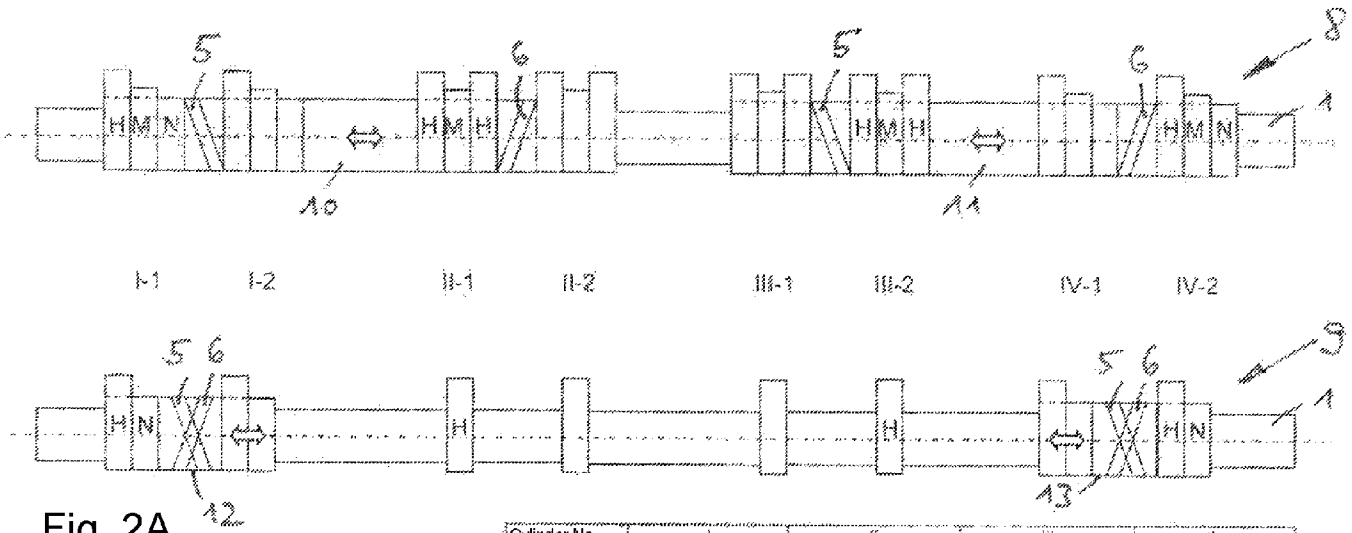

Fig. 2A

| Cylinder No. | | | | | | | | | | | | | | | | |
|---|---|---|---|---|---|---|---|---|---|---|---|---|---|---|---|---|
| Intake | axial position | R | M | L | R | M | L | R | M | L | R | M | L | R | M | L |
| | valve stroke | high | medium | zero | high | medium | high | high | medium | high | high | medium | high | high | medium | zero |
| Exhaust | axial position | R | | L | | | | | | | | | | | | |
| | valve stroke | high | | zero | | | | | | | | | | | | |
| Mode A | Intake | | high | | | high | | | high | | | high | | | high | |
| | Exhaust | | high | | | high | | | high | | | high | | | high | |
| Mode B | Intake | | medium | | | medium | | | medium | | | medium | | | medium | |
| | Exhaust | | high | | | high | | | high | | | high | | | high | |
| Mode C | Intake | | zero | | | high | | | high | | | high | | | zero | |
| | Exhaust | | zero | | | high | | | high | | | high | | | zero | |

Fig. 2B

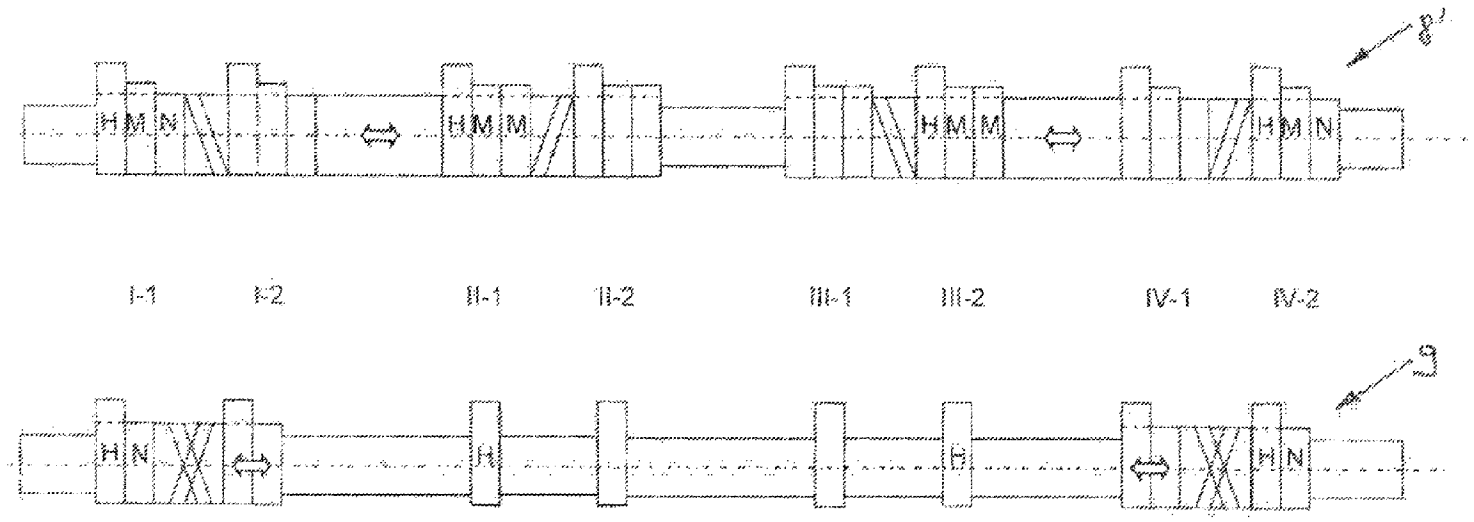

Fig. 3A

| Cylinder No. | | | | | | | | | | | | | | | |
|---|---|---|---|---|---|---|---|---|---|---|---|---|---|---|---|
| Intake | axial position | R | | M | | L | | R | | M | | L | | R | | M | | L |
| | valve stroke | high | | medium | | zero | | high | | medium | | medium | | high | | medium | | zero |
| Exhaust | axial position | R | | | | L | | | | | | | | R | | | | L |
| | valve stroke | high | | | | zero | | | | | | | | high | | | | zero |

| | | | | | | | | | | | | | | | | | | |
|---|---|---|---|---|---|---|---|---|---|---|---|---|---|---|---|---|---|---|
| Mode A | Intake | | | high | | | | high | | | | high | | | | high | | |
| | Exhaust | | | high | | | | high | | | | high | | | | high | | |
| Mode B | Intake | | | medium | | | | medium | | | | medium | | | | medium | | |
| | Exhaust | | | high | | | | high | | | | high | | | | high | | |
| Mode C | Intake | | | zero | | | | medium | | | | medium | | | | zero | | |
| | Exhaust | | | zero | | | | high | | | | high | | | | zero | | |

Fig. 3B

VARIABLE-STROKE VALVE TRAIN OF AN INTERNAL COMBUSTION ENGINE

BACKGROUND

The invention relates to a valve train of an internal combustion engine with a four-cylinder in-line arrangement and variable-stroke actuation of the gas exchange valves. The valve train comprises a first camshaft having a carrier shaft and precisely two first cam pieces, which are arranged for conjoint rotation thereon and so as to be movable between at least two axial positions and which each actuate the intake or exhaust valves of two adjacent engine cylinders by at least two first groups of adjacent cams having different lobes.

A sliding cam valve train of this kind, in which the gas exchange valves of two adjacent engine cylinders are actuated by a common cam piece, is known from DE 10 2005 006 489 A1 and DE 10 2009 016 902 A1. A prerequisite for the reduction achieved here in the complexity of the camshaft is the adequate size of the common base circle angle of all the cams of a cam piece since only this angular range is available for the shifting thereof in operation. Consequently, in-line four-cylinder engines (R4) having two overhead camshafts (DOHC) and the standard ignition sequence 1-3-4-2, in particular, are suitable for this purpose.

As part of the continued tightening of the emission regulations, there is now also an R4 engine with a sliding cam valve train and cylinder shutdown in production—see Motortechnische Zeitschrift MTZ March 2012: "Der 1,4-L-TSI-Ottomotor mit Zylinderabschaltung" ("The 1.4-l TSI spark-ignition engine with cylinder shutdown").

SUMMARY

It is the object of the invention to specify the variability of the stroke of a valve train of the type noted at the outset with a view to further reducing emissions from internal combustion engines in the various operating modes thereof.

This object is achieved by one or more features of the invention. According to this, the valve train should have a second camshaft, which comprises a carrier shaft and precisely two second cam pieces, which are arranged for conjoint rotation thereon and so as to be movable between at least two axial positions and which each actuate the respective other intake or exhaust valves of just one engine cylinder by at least one second group of adjacent cams having different lobes. In this case, the lobes of simultaneously actuating cams of the first cam groups are supposed to be different and to include a zero stroke and the second cam groups are each supposed to include a cam having a zero stroke in order to stop the intake and exhaust valves of the two engine cylinders, the exhaust and intake valves of which are actuated by the second cam pieces.

As a result, a DOHC sliding cam valve train for an R4 engine is obtained which has just four cam pieces and which, on the one hand, can be operated in the cylinder shutdown mode and the intake or exhaust valves of which, for the engine cylinders that cannot be shut down, are operated with two different cam lobes.

BRIEF DESCRIPTION OF THE DRAWINGS

Further features of the invention will become apparent from the following description and from the drawings, in which two illustrative embodiments of a valve train according to the invention are shown. Unless otherwise mentioned, features or components which are the same or functionally the same are provided with the same reference numbers here. In the drawings:

FIG. 2A shows the intake and exhaust shafts of the first valve train according to the invention in schematic view;

FIG. 2B shows the three operating modes of the first valve train in table form;

FIG. 3A shows the intake and exhaust shafts of the second valve train according to the invention in schematic view; and FIG. 3B shows the three operating modes of the second valve train in table form.

DETAILED DESCRIPTION OF THE PREFERRED EMBODIMENTS

Figure 1:
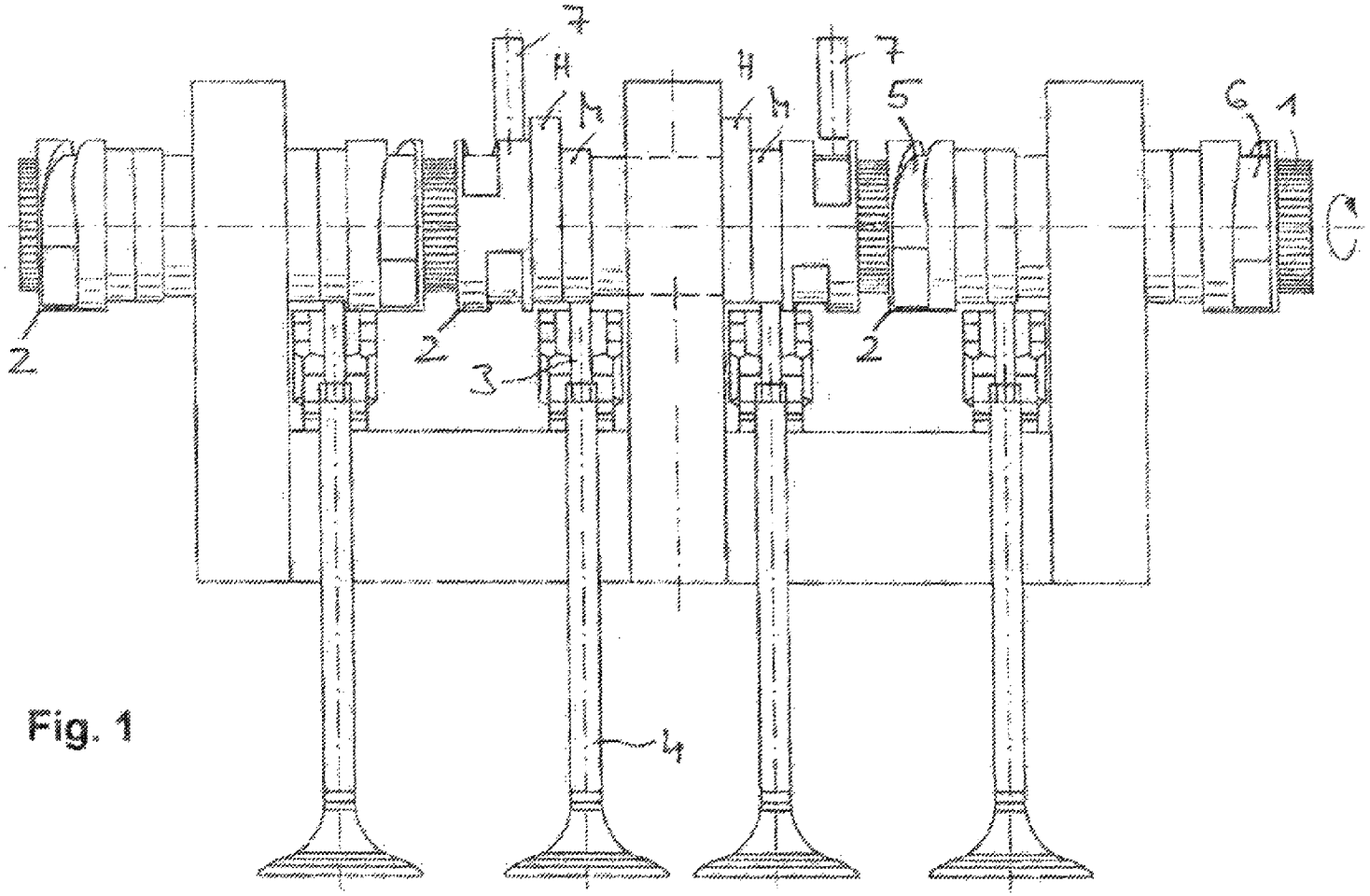
FIG. 1 shows a detail of a known sliding cam valve train in side view.

The invention will be explained starting with FIG. 1, in which a known variable-stroke valve train of an internal combustion engine is shown. The basic operating principle of the valve train can be summarized in that a camshaft of conventionally rigid design is replaced by an externally toothed carrier shaft 1 and cam pieces 2 mounted for conjoint rotation and axial movement thereon by internal toothing. Each cam piece has two groups of axially adjacent cams having two lobes H and M of different sizes, the lift of which is transmitted selectively to the gas exchange valves 4 by finger levers 3. The movement of the cam piece on the carrier shaft required to activate the respective cam in accordance with the operating point is accomplished by means of two axial slotted guides extending over the cam piece and having slotted guide tracks 5 and 6 in the form of grooves, which differ in orientation in accordance with the direction of movement and in which a respective actuating pin 7 of an actuator (not shown) engages, depending on the instantaneous position of the cam piece.

FIG. 2A shows the two camshafts of a first DOHC valve train according to the invention for an R4 engine having two intake valves and two exhaust valves per engine cylinder and the ignition sequence 1-3-4-2. The first camshaft, which is at the top in the figure, is the intake shaft 8, and the second camshaft, at the bottom in the figure, is the exhaust shaft 9.

The intake shaft 8 is made up of the externally toothed carrier shaft 1 and two first cam pieces 10 and 11, which are mounted for conjoint rotation and so as to be axially movable between three positions on the carrier shaft by the internal toothing of said cam pieces. One first cam piece 10 actuates the intake valves of the two engine cylinders I and II, and the other first cam piece 11 actuates the intake valves of the two engine cylinders III and IV. Each of these cam pieces has four first groups, each comprising three adjacent inlet cams having different lobes. The Roman numeral in the designation I-1 to IV-2 of the intake- and exhaust-side cam groups refers to the respective engine cylinder, and the Arabic numeral in said designation refers to the first or second valve of said engine cylinder, each opening with the same lobe. The slotted guide tracks 5 and 6 of axially opposite orientation, into each of which one of two actuating pins engages in order to be able to move the first cam pieces into each of the three axial positions, extend between two adjacent cam groups of each engine cylinder.

The exhaust shaft 9 is made up of the externally toothed carrier shaft 1 and two second cam pieces 12 and 13, which are mounted for conjoint rotation and axial movement between two positions on the carrier shaft by means of the internal toothing of said cam pieces. One cam piece 12 actuates the exhaust valves of engine cylinder I and the other second cam piece 13 actuates the exhaust valves of the engine cylinder IV. Each of these cam pieces has two second cam groups I-1, I-2 and IV-1, IV-2, each having two adjacent exhaust cams with different lobes. Unlike the axially movable cam pieces, the exhaust cam pairs II-1, II-2 and III-1, III-2 of engine cylinders II and III, respectively, are joined firmly to the carrier shaft. The slotted guide tracks 5 and 6 arranged between the two cam groups intersect, and therefore only one actuating pin is required in each case to move these cam pieces into the two axial positions.

The qualitative size of the individual cam lobes and the three corresponding operating modes A to C of the internal combustion engine are listed in the form of a table in FIG. 2B. The first cam groups I-1 to IV-2 of the intake shaft 8 have simultaneously actuating cams with different lobes. The cams, denoted by N, of cam groups I-1 and I-2, and IV-1 and IV-2, are namely cams with a zero stroke N for the purpose of stopping the intake valves of the engine cylinders I and IV while, at the same time, the intake valves of engine cylinders II and III are actuated by the cams with a large lobe H. In this cylinder shutdown mode C, the second cam pieces of the exhaust valves 9 are likewise in the left-hand axial position L, and therefore their cams with a zero stroke N also stop the exhaust valves of engine cylinders I and IV. In contrast, the exhaust valves of the engine cylinders II and III which are not shut down are actuated by the fixed cams having a large lobe H.

Mode B: starting from mode C, movement of the first and second cam pieces 10, 11 and 12, 13, respectively, by one axial position (to the right into position M in FIG. 2A) has the effect that all the intake valves of cams with a medium-sized lobe M are actuated and that all the exhaust valves of cams having a large lobe H are actuated.

Mode A: starting from mode B, a further movement of the first cam pieces 10, 11 by one axial position (to the right into position R in FIG. 2A) has the effect that the intake valves are also actuated by cams having a large lobe H.

The second valve train according to the invention, as shown in FIGS. 3A and 3B, differs from the valve train explained above only in the configuration of the intake shaft 8': in this case, the intake valves of engine cylinders II and III are actuated by cams having a medium-sized lobe M in the cylinder shutdown mode C.

Alternative embodiments (not shown) of the inventions can be:

- stopping engine cylinders II and III instead of I and IV in the cylinder shutdown mode
- in the figures, the first camshaft is the exhaust shaft, and the second camshaft is the intake shaft
- cam pieces having other known slotted guide tracks
- both camshafts have a stroke which is variable in either three stages or just two stages.

LIST OF REFERENCE SIGNS

1 carrier shaft
2 cam piece
3 end pivot follower
4 gas exchange valve
5 slotted guide track
6 slotted guide track
7 actuating pin
8 first camshaft, intake shaft
9 second camshaft, exhaust shaft
10 first cam piece
11 first cam piece
12 second cam piece
13 second cam piece

The invention claimed is:

1. A valve train of an internal combustion engine with four-cylinder in-line arrangement and variable-stroke actuation of the gas exchange valves, comprising: a first camshaft, which comprises a carrier shaft and precisely two first cam pieces, which are arranged for conjoint rotation thereon and so as to be movable between at least two axial positions and which each actuate intake or exhaust valves of two adjacent engine cylinders by at least two first groups of adjacent cams having different first lobes, a second camshaft, which comprises a carrier shaft and precisely two second cam pieces, which are arranged for conjoint rotation thereon and so as to be movable between at least two axial positions and which each actuate the respective other of the intake or exhaust valves of just one engine cylinder by at least one second group of adjacent second cams having different second lobes, the lobes of simultaneously actuating first cams of the first cam groups are different and include a zero stroke and the second cam groups each include one of the second cams having a zero stroke in order to stop the intake and exhaust valves of the two engine cylinders, the respective exhaust or intake valves of which are actuated by the second cam pieces.

2. The valve train as claimed in claim 1, wherein the first camshaft is an intake shaft and the second camshaft is an exhaust shaft.

3. The valve train as claimed in claim 1, wherein the first cam groups each have precisely three of the first cams and the second cam groups each have precisely two of the second cams.

4. The valve train as claimed in claim 3, wherein the first cam groups each have one of the first cams having a medium-sized lobe and one of the first cams having a large lobe, and the first cam having the zero stroke and the first cam having the medium-sized lobe actuate simultaneously.

5. The valve train as claimed in claim 3, wherein the first cam groups each have one of the first cams having a medium-sized lobe and one of the first cams having a large lobe, and the first cam having the zero stroke and the first cam having the large lobe actuate simultaneously.

6. The valve train as claimed in claim 1, wherein the valve train stops the gas exchange valves of the first and fourth engine cylinders.

* * * * *